US007733220B2

(12) United States Patent
Libby

(10) Patent No.: US 7,733,220 B2
(45) Date of Patent: Jun. 8, 2010

(54) SYSTEM AND METHODS FOR DETECTING CHANGE IN A MONITORED ENVIRONMENT

(75) Inventor: Vibeke Libby, Woodside, CA (US)

(73) Assignee: Northrop Grumman Corporation, Los Angeles, CA (US)

( * ) Notice: Subject to any disclaimer, the term of this patent is extended or adjusted under 35 U.S.C. 154(b) by 916 days.

(21) Appl. No.: 11/543,551

(22) Filed: Oct. 5, 2006

(65) Prior Publication Data

US 2008/0084295 A1 Apr. 10, 2008

(51) Int. Cl.
*G08B 1/08* (2006.01)

(52) U.S. Cl. ..... 340/539.1; 340/539.22; 340/511; 340/541; 340/561; 340/565

(58) Field of Classification Search ..... 340/539.1, 340/539.22, 539.23, 541, 561, 565, 566, 340/567, 501, 511, 506, 517
See application file for complete search history.

(56) References Cited

U.S. PATENT DOCUMENTS 5,986,357 A * 11/1999 Myron et al. ..... 307/116
6,064,303 A * 5/2000 Klein et al. ..... 340/506
6,078,253 A * 6/2000 Fowler ..... 340/501
6,107,918 A * 8/2000 Klein et al. ..... 340/511
6,646,550 B1 * 11/2003 Runyon et al. ..... 340/541
7,079,034 B2 * 7/2006 Stilp ..... 340/573.1
7,129,840 B2 * 10/2006 Hull et al. ..... 340/568.1
7,382,244 B1 * 6/2008 Donovan et al. ..... 340/506
7,411,489 B1 * 8/2008 Elwell et al. ..... 340/501
7,486,193 B2 * 2/2009 Elwell ..... 340/573.1
2005/0037776 A1 2/2005 Perez-Breva et al.

* cited by examiner

*Primary Examiner*—Davetta W Goins
(74) *Attorney, Agent, or Firm*—Tarolli, Sundheim, Covell & Tummino LLP

(57) ABSTRACT

Systems and methods are provided for detecting changes in a monitored environment. One aspect of the invention relates to a system that comprises a plurality of radio frequency (RF) sensors distributed about the monitored environment, such that each RF sensor configured to respond to an interrogation signal with a unique identifier and a radio frequency (RF) interrogator that transmits interrogation sequences of interrogations signals over a plurality of different frequency bands at one or more power levels. The system also includes a response pattern analyzer that determines response patterns for each of the plurality of RF sensors to the interrogation sequences and transmits a change detection indicator if at least one of the determined response patterns vary outside a predetermined background baseline.

22 Claims, 7 Drawing Sheets

SYSTEM AND METHODS FOR DETECTING CHANGE IN A MONITORED ENVIRONMENT

TECHNICAL FIELD

The present invention relates generally to security systems, and more particularly to systems and methods for detecting change in a monitored environment.

BACKGROUND

Security systems are employed to detect changes in a monitored environment due to the intrusion of an entity, such as an unwanted human, animal or inanimate object. However, many security systems find it difficult to perform proper motion and change detection without being subjected to false alarms. Some of these alarms are due to normal changes to the setting, like moving curtains, changing airflow, automatic light switching, pests or other non-harmful entities entering the monitored background. Routinely, these events are made part of the background to minimize false alarms, but unfortunately, such action at the same time lowers the probability of detecting small changes like for example the placement of an electronic bug in the monitored environment.

Additionally, many security systems are easy to spoof. For example, systems that detect heat generated from a human body can be spoofed by a person wearing a large coat and moving slowly through a room. Also, these systems may not detect the entrance of an electronic robot, or other inanimate object entering the room. Laser beam type security systems can be spoofed using mirrors, or by avoiding the laser beams when moving through the room. Security systems that employ cameras can be spoofed by moving outside of the field of view of the cameras, or moving between objects blocking the field of view of the cameras.

SUMMARY

One aspect of the invention relates to a system for detecting changes in a monitored environment. The system comprises a plurality of radio frequency (RF) sensors distributed about the monitored environment, such that each RF sensor is configured to respond to an interrogation signal with a unique identifier, and a radio frequency (RF) interrogator that transmits interrogation sequences of interrogations signals over a plurality of different frequency bands at one or more power levels. The system also includes a response pattern analyzer that determines response patterns for each of the plurality of RF sensors to the interrogation sequences and transmits a change detection indicator if at least one of the determined response patterns vary outside a predetermined background baseline.

In another aspect of the invention, a security system is provided for detecting changes in a monitored environment. The system comprises a plurality of means for responding to an interrogation signal with a unique identifier, the plurality of means for responding being distributed about the monitored environment, means for transmitting interrogation sequences of interrogation signals over a plurality of different frequency bands at a plurality of power levels, and means for determining response patterns for each of the plurality of RF sensors to the interrogation sequences. The system further comprises means for determining if response patterns vary outside a predetermined background baseline, and means for providing an indication if response patterns vary outside the predetermined background baseline.

In yet a further aspect of the invention, a method is provided for detecting changes in a monitored environment. The method comprises distributing a plurality of radio frequency (RF) sensors distributed about the monitored environment, each RF sensor is configured to respond to an interrogation signal with a unique identifier, repeatedly transmitting interrogation sequences of interrogations signals over a plurality of different frequency bands at one or more power levels for a given time period, determining response patterns for each of the plurality of RF sensors to the interrogation sequences to determine a site background baseline and determining and storing change thresholds from the determined site background baseline. The method further comprises repeatedly transmitting the interrogation sequences of interrogations signals over the plurality of different frequency bands at one or more power levels during a security monitoring time period to determine changes in the monitored environment, and transmitting a change detection indicator if at least one of the determined response patterns vary outside the change thresholds.

DETAILED DESCRIPTION

Figure 1:
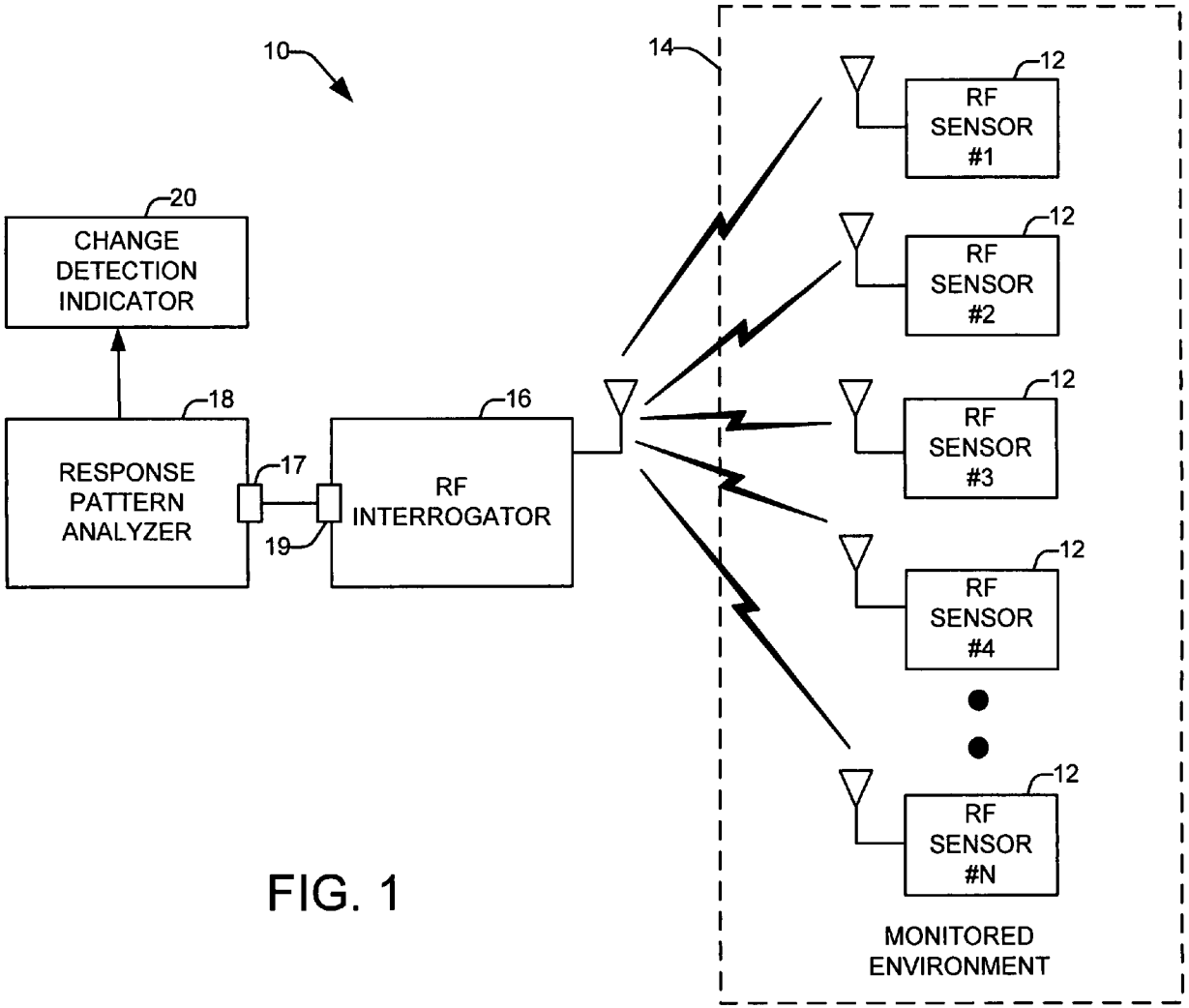
FIG. 1 illustrates a block diagram of a system for detecting changes in a monitored environment in accordance with an aspect of the present invention.

The present invention relates to systems and methods for detecting change in a monitored environment. The systems and methods employ radio frequency (RF) sensor responses to interrogation signals of an RF interrogator in a monitored environment to determine response patterns associated with a plurality of RF sensors. Even slight changes in these response patterns signify changes in the monitored environment. Each RF sensor can represent a communication channel having one or more background baseline response patterns. Changes in one or more channels can be readily detected and compared to the one or more background baseline channels. If one or more of the channels has changed, then the monitored environment has likely undergone some change. The utilization of RF sensors mitigates problems associated with spoofing of lineof-site sensors, and heat detection sensors. For example, metal robots, electronic devices and any other animate or inanimate object introduced into the monitored environment will change the response patterns of one or more RF sensors.

As the number of RF sensors in the monitored environment increase, the number of communication channels increase, thus increasing the statistical confidence in a change event, since the probability that multiple channels would be affected simultaneously is highly unlikely to occur at random. Therefore, the false alarm rate for the systems and methods is substantially low. The present invention can employ RF commercial off the shelf (COTS) technology, and therefore can be implemented at relatively low costs.

Each sensor is in a unique position in space with respect to the interrogator(s) and senses the background and environment in its own unique way. Since the sensors represent a distributed sensor array, each of them is also uniquely positioned with respect to object that create normal event changes in the monitored environment (e.g., moving curtains, air vents turning on and off, and lights going dim). Therefore, they each change their communication response in a unique way as the normal changes occur. Statistically, these events are repeatable and their signatures can be stored as recognizable normal background events.

The present invention can be employed in a variety of different applications. For example, the present invention can be employed to monitor the theft and replacement of a high value item with a lesser one, such as a warehouse setting where a carton of designer handbags is replaced by a same size box of paper towels. Although the box and ID tag may still be intact, the content has changed. The present invention can be employed to detect this content change with the described system.

Another application along the same lines is the tampering of electronic goods. For example, the inside of a computer chassis can be equipped with a couple of sensors. Through a connector, a baseline signature can be taken before the computer leaves the manufacturer with the interrogator. When the computer reaches its final destination, a signature is taken again to verify that the interior has not changed, such as boards have not been added or replaced, a listening device is not installed, or any harmful materials inserted.

A third larger scale application is the inspection and integrity of shipping containers. The present invention can be employed to identify that theft or entry has occurred during shipping, especially for high value items like cars. The present invention can work well inside a metal box, because so many reflection of the RF signal can be detected off the metal walls.

FIG. 1 illustrates a system 10 for detecting changes in a monitored environment 14 in accordance with an aspect of the present invention. The system 10 includes a plurality of radio frequency (RF) sensors 12, labeled #1 through #N, where N is an integer greater than zero, distributed within the monitored environment 14. The monitored environment 14 can be, for example, a room, a parking lot, a lobby, a field, a street, an intersection or a variety of other environments. The plurality of RF sensors 12 can be distributed in a pattern, or randomly distributed within the monitored environment 14. The distribution or known locations of the RF sensors 12 are not important, as long as the RF sensors 12 are within range to respond to an interrogation signal by an RF interrogator 16. The RF interrogator 16 can be located within the monitored environment 14 or outside the monitored environment 14, as long as the RF interrogator 16 can receive response signals from the RF sensors 12.

The RF interrogator 16 is configured to transmit interrogation signals in the monitored environment 14 and receive response signals from the plurality of RF sensors 12. The RF interrogator 16 transmits interrogation signals over a set of frequency bands at one or more power levels for each of a given interrogation sequence. In one aspect of the invention, the RF interrogator 16 transmits interrogation signals employing spread spectrum frequency hopping that generates pseudo-random frequency bands over different interrogation sequences. A given interrogation sequence can include, for example, 50 interrogation signals at different frequency bands at a given power level, and repeat the generation of 50 interrogation signals at a plurality of power levels.

Each RF sensor 12 is configured to respond to an interrogation signal with a unique identifier associated with a given RF sensor 12. At certain power levels and frequency bands, a given RF sensor 12 may not respond, or may not respond with enough power for the RF interrogator 16 to have a valid read for that respective RF sensor 12. These failures may be due to location of a given sensor 12 relative to the RF interrogator 16, objects in the environment and/or operational variances of the RF sensors 12 relative to one another. The combination of valid reads and failed or invalid reads over an interrogation sequence provide a response pattern for a given RF sensor. The response pattern can be represented as a binary sequence with valid reads being represented with a logic "1" and invalid reads being represented as a logic "0" for each frequency band and power level interrogation sequence. Changes in the response patterns for one or more RF sensors 12 provide an indication that a change in the monitored environment 14 has occurred.

The RF interrogator 16 is coupled to a response pattern analyzer 18, for example, through associated ports 17 and 19. The response pattern analyzer 18 determines response patterns for each RF sensor and compares the response patterns of the associated RF sensors 12 to one or more predetermined expected response thresholds. Each RF sensor has its own unique set of threshold values. For example, the predetermined expected response thresholds can be determined by establishing a background baseline during a calibration procedure. The background baseline can be established by continuously analyzing response patterns over a given time period during normal background monitoring conditions. In this manner, response patterns can be collected associated with normal background changes in the monitored environment 14, such as an air condition turning on, a curtain blowing, normal traffic patterns, trees or grass movement, unharmful pests or animals passing through the monitored environment 14 or other naturally occurring events within the monitored environment 14. These normally occurring response patterns can be employed to establish change thresholds, or a set of change signatures that can be compared with response patterns collected during security monitoring to determine if any changes have occurred in the monitored environment 14 outside the normally expected background changes. If the response pattern analyzer 18 determines that one or more response patterns, or an aggregation of changes to response patterns have exceeded change thresholds, or vary beyond a threshold with stored change signatures, the response pattern analyzer 18 will activate a change detection indicator 20. The change detection indicator 20 can be an alarm, a blinking light, a report, or a variety of other indicator types that provide an indication that an unexpected change in the monitored environment has occurred.

The response pattern analyzer 18 can be employed to determine entry into the monitored environment 14 combined with accurate change detection at substantially no additional cost.

For example, the response pattern analyzer 18 can be employed to detect entry and departure into and out of a monitored environment 14 as well as determine if anything in the monitored environment 14 has changed as the result of the entry. For example, the response pattern analyzer 18 can be employed to map an intruder's entry and path through the monitored environment 14 allowing for easy investigation of the potential change location in the monitored environment 14.

As the intrusion progresses multiple data samples can be taken to track the intruder. As long as the background baseline changes the motion is still occurring. Therefore, multiple temporary "background baselines" can be maintained as long as the intrusion is in progress. As the data samples are analyzed, they can be compared to the last temporary background baseline. This functionality can be employed to determine when the intrusion has ceased. If the resulting data collected is within the original site background baseline, it is know that the intrusion occurred and that nothing was altered. However, if the resulting data does not fit within the original site background baseline, something has changed (added, moved, or removed) from the monitored environment as a result of the intrusion.

Additionally, since the system 10 allows for programmable data collection, the collection frequency can be programmed to be change driven. For example, a strategy could be to increase the collection frequency as changes are detected. The response pattern analyzer 18 can transmit a control signal to the RF interrogator 16 to increase the rate of transmitting interrogation sequences upon detecting a change in the monitored environment.

Figure 2:
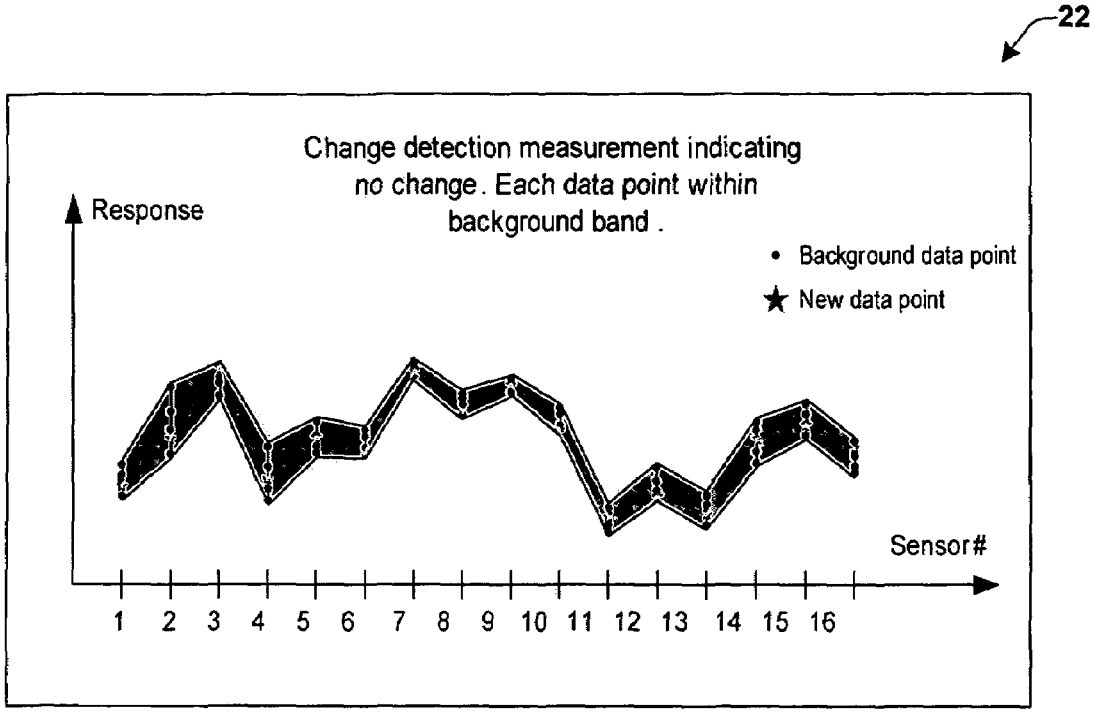
FIG. 2 illustrates a graph of response versus sensor numbers for a normal background of a monitored environment.
Figure 3:
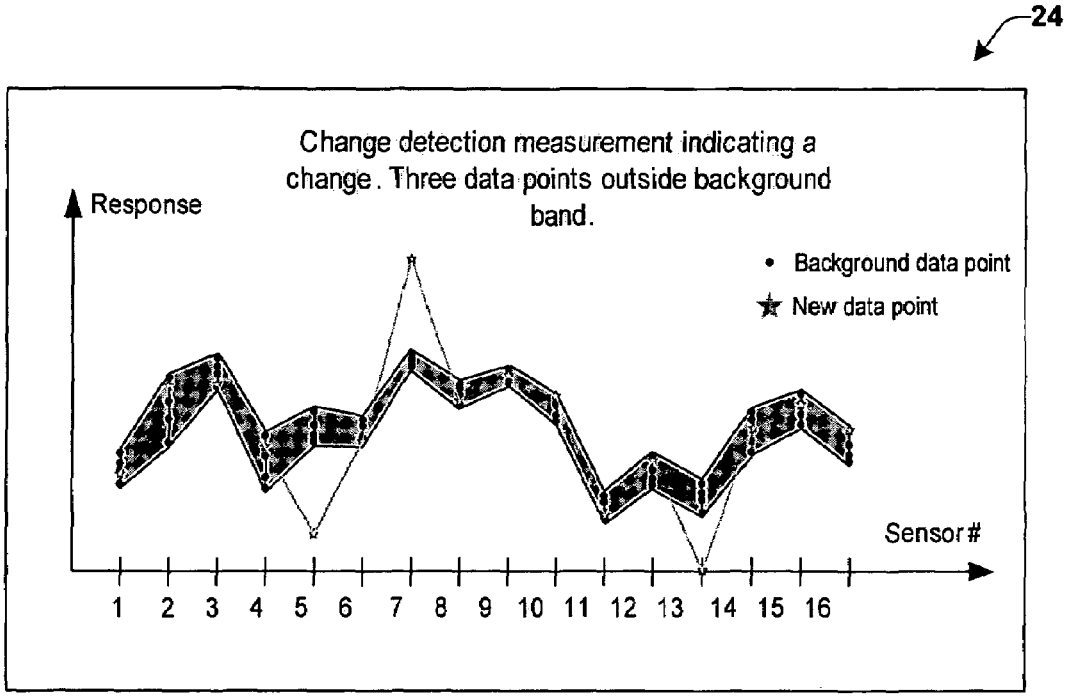
FIG. 3 illustrates a graph of response versus sensor numbers for a change in a normal background of a monitored environment.

FIGS. 2 and 3 illustrate graphs of responses versus sensor numbers for a sample of 16 sensors in a monitored environment. FIG. 2 illustrates a graph 22 of response versus sensor numbers for a normal background of a monitored environment. The responses can be, for example, a number of valid reads or a number of failed reads for a given interrogation sequence. The variability of the responses can be due to normal background changes in the environment and/or the use of pseudo-random frequency hopping. In FIG. 2, the sampled data falls within the background band, showing that no unexpected change has occurred. The band can be created and updated as the setting's background baseline configuration changes. This could be caused by adding a printer or a picture to a room, or as the result of repainting a parking lot, now allowing for a higher density of cars to be parked outside the building, or any change in the environment that is not considered unexpected.

FIG. 3 illustrates a graph 24 of response versus sensor numbers for a change in a normal background of a monitored environment. In FIG. 3, three of the sensors are reporting data outside the expected noise band and therefore suggest that an unexpected change to the environment has occurred. Additionally, the response from sensor 13 has disappeared, suggesting that the change is now blocking the communication path between the sensor and the interrogator.

Figure 4:
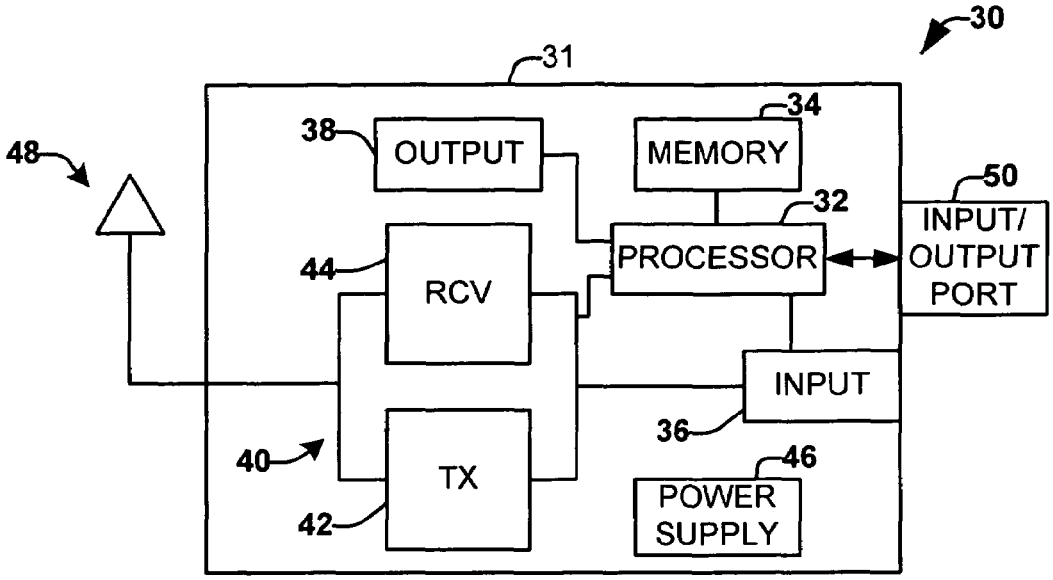
FIG. 4 is a block diagram representing a basic structure of a RF interrogator in accordance with an aspect of the present invention.
Figure 5:
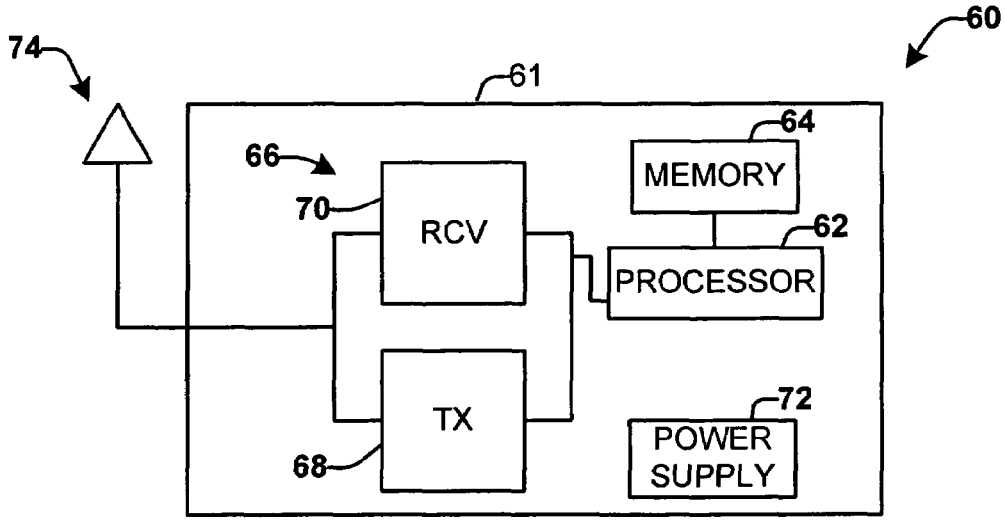
FIG. 5 illustrates an exemplary block diagram representing a basic structure of a RF sensor in accordance with an aspect of the present invention.

FIG. 4 is a block diagram representing the basic structure of a RF interrogator 30 in accordance with an aspect of the present invention. The RF interrogator 30 is contained within a housing 31 and includes an RF section 40 containing an RF receiver 44 and an RF transmitter 42. The RF receiver 44 is operable to receive RF responses from one or more RF sensors via an antenna 48 internal (or external) to the housing 31. The received transmissions are processed as valid or invalid reads and output to an output device 38 (e.g., a display) and/or an input/output port 50. The RF transmitter 42 is operable to broadcast RF interrogation signals, via the internal (or external) antenna 48. A processor 32 can be programmed via memory 32 that is internal or external to the processor 32 to frequency hop through a plurality of frequency bands at a plurality of different power levels by controlling transmission frequency and power to establish interrogation sequences. The processor 32 can be further programmed to determine if valid or failed RF sensor responses have been received for a plurality of RF sensors, and to determine and/or transmit responses for a given interrogation sequence for each of a plurality of RF sensors to the input/output port 50 for processing by an external device (e.g., a computer). The processor 32 can be preprogrammed, or programmed through the input/output port 50. A power supply 46 is included to provide operating power to the RF interrogator 30. The power supply 46 can be a battery or a power supply powered by a standard wall plug FIG. 5 illustrates an exemplary block diagram of a RF sensor 60 in accordance with an aspect of the present invention. The RF sensor 60 is maintained within a housing 61, and includes a processor 62 or controller which can be programmed to respond to an interrogation signal of a RF interrogator with a unique identifier associated with the RF sensor 60. The RF sensor can be active or passive. An active sensor emits signals at regular preset intervals, while the passive sensor is powered by an interrogation signal. A memory 64 is included in the RF sensor 60 for storing, among other things, program code executed by the processor 62. The memory 64 also serves as a storage medium for storing a unique identification code used to designate and distinguish the RF sensor 60 from the other RF sensors within a monitored environment. The memory 64 can be external or internal to the processor 62. The RF sensor 60 includes an RF section 66 connected to the processor 62. The RF section 66 includes an RF receiver 70 which receives RF interrogation signals from a RF interrogator via an antenna 74 external or internal to the housing 61. The RF section 66 also includes an RF transmitter 68 operable to transmit response signals that include the unique identifier via the antenna 74. A power supply 72 may be included to provide operating power to the RF sensor.

Figure 6:
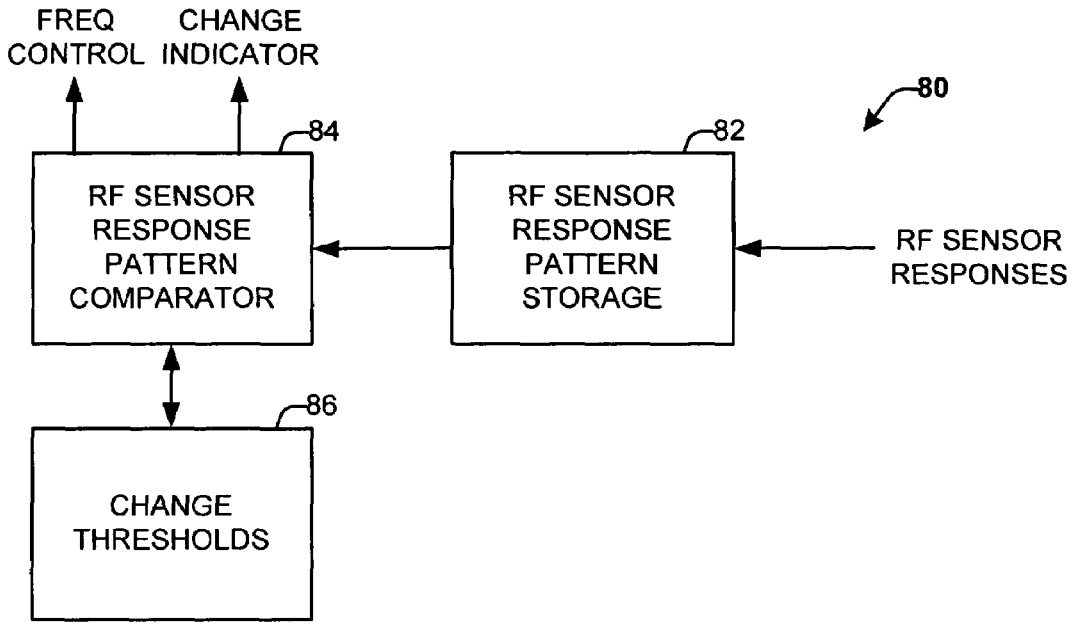
FIG. 6 illustrates a block diagram of a RF response pattern analyzer in accordance with an aspect of the present invention.

FIG. 6 illustrates a block diagram of a RF response pattern analyzer 80 in accordance with an aspect of the present invention. The RF response pattern analyzer 80 is configured to receive a plurality of RF sensor responses from a plurality of RF sensors over one or more interrogation sequences, and store RF sensor response patterns associated with each RF sensor for a given interrogation sequence in a RF sensor response pattern storage 82. The RF response analyzer 80 includes a RF sensor pattern comparator 84 that compares the stored sensor response patterns in the RF sensor response pattern storage 82 with a plurality of change thresholds 86 that are pre-stored based on sampling of normal conditions of a monitored environment. The RF sensor pattern comparator 84 is configured to transmit a change indicator signal in response to a determination that one or more RF sensor response patterns have exceeded one or more change thresholds 86 or has exceeded an aggregation of one or more change thresholds 86. The RF sensor pattern comparator 84 can be configured to transmit a control signal to an RF interrogator to increase the rate of transmitting interrogation sequences upon detecting a change in the monitored environment. The RF sensor pattern comparator 84 can also be configured to track movement of an intruder through the monitored environment.

Figure 7:
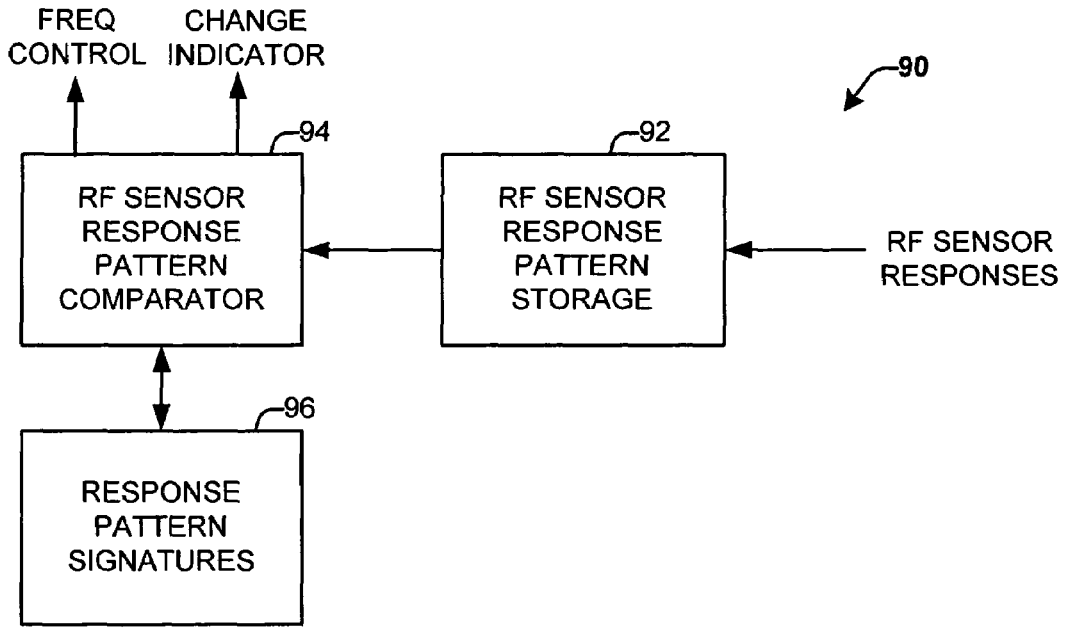
FIG. 7 illustrates a block diagram of a RF response pattern analyzer in accordance with another aspect of the present invention.

FIG. 7 illustrates a block diagram of a RF response pattern analyzer 90 in accordance with another aspect of the present invention. The RF response pattern analyzer 90 is configured to receive a plurality of RF sensor responses from a plurality of RF sensors over one or more interrogation sequences and store RF sensor response patterns associated with each RF sensor for a given interrogation sequence in a RF sensor response pattern storage 92. The RF response analyzer 90 includes a RF sensor pattern comparator 94 that compares the stored sensor response patterns in the RF sensor response pattern storage 92 with a plurality of response pattern signatures 96 associated with corresponding RF sensors that are pre-stored based on sampling of normal conditions of a monitored environment. The RF sensor pattern comparator 94 is configured to transmit a change indicator signal in response to a determination that one or more RF sensor response patterns have varied from one or more of associated response pattern signatures 96 for each given sensor or an aggregation of sensor patterns have varied from one or more associated response pattern signatures 96. The RF sensor pattern comparator 94 can be configured to transmit a control signal to an RF interrogator to increase the rate of transmitting interrogation sequences upon detecting a change in the monitored environment. The RF sensor pattern comparator 94 can also be configured to track movement of an intruder through the monitored environment.

Figure 8:
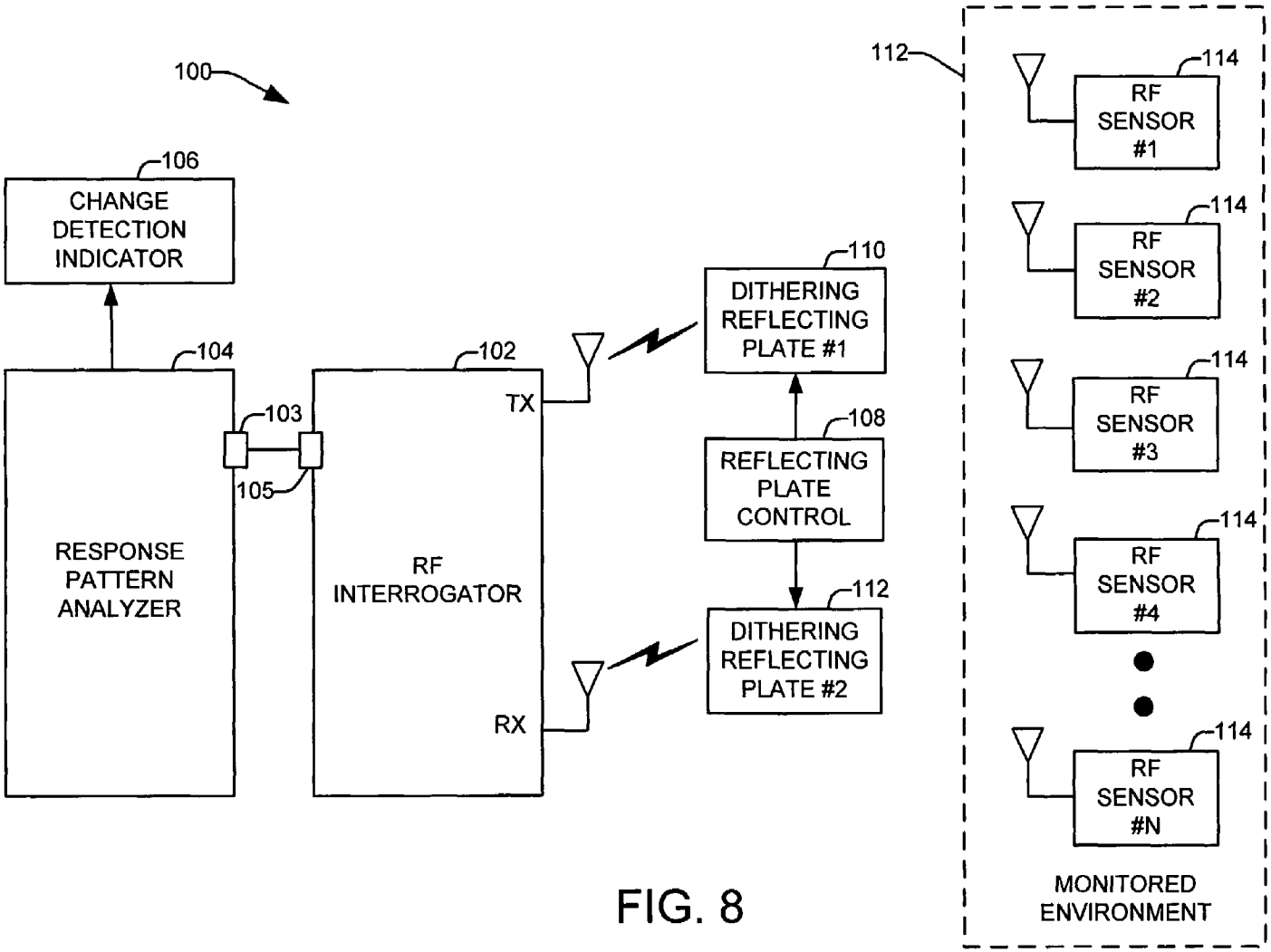
FIG. 8 illustrates a block diagram of another system for detecting changes in a monitored environment in accordance with an aspect of the present invention.

FIG. 8 illustrates an alternate system 100 for detecting changes in a monitored environment in accordance with an aspect of the present invention. The system 100 includes a plurality of radio frequency (RF) sensors 114, labeled #1 through #N, where N is an integer greater than zero, distributed within the monitored environment 112. The distribution or known locations of the RF sensors 114 are not important, as long as the RF sensors 114 are within range to respond to an interrogation signal by an RF interrogator 102. The RF interrogator 102 can be located within the monitored environment 112 or outside the monitored environment 112, as long as the RF interrogator 102 can receive response signals from the RF sensors 114.

The RF interrogator 102 is configured to transmit interrogation signals in the monitored environment 112 over a transmitter (TX) and receive response signals from the plurality of RF sensors 114 at a receiver (RX). The RF interrogator 102 transmits interrogation signals over a set of frequency bands, for example, employing spread spectrum frequency hopping that generates pseudo-random frequency bands over different interrogation sequences. The system 100 can include one or more movable dithering reflecting plates that move over different positions to modify the transmission distance, receipt power and/or alter the multi-path effects of the transmit and/or receive signals. The one or more dithering reflecting plates can provide the same effects as modifying the transmission power at the RF interrogator, but be collected faster and avoid the potential hysteresis effects associated with sequential modification of the transmission power.

In the present example, the system 100 includes a first dithering reflecting plate 110 located between the transmitter and the sensors, 114 and a second dithering reflecting plate 112 located between the receiver and the sensors 114. The system 100 further comprises a reflecting plate control 108 that controls the movement of the first and second dithering reflecting plate 110 and 112. It is to be appreciated that a single reflecting plate can be placed in front of one of the transmitter and receiver to provide a similar effect. By moving the first or second dithering reflecting plate 110 and 112 over a plurality of positions, a response pattern for each sensor can be captured similar to a response pattern captured by modifying power as illustrated in FIG. 1.

The RF interrogator 102 is coupled to a response pattern analyzer 104, for example, through associated ports 103 and 105. The response pattern analyzer 104 determines response patterns for each RF sensor and compares the response patterns of the associated RF sensors 114 to one or more predetermined expected response thresholds. If the response pattern analyzer 104 determines that one or more response patterns, or an aggregation of changes to response patterns have exceeded change thresholds, or vary beyond a threshold with stored change signatures, the response pattern analyzer 104 will activate a change detection indicator 106. The change detection indicator 106 can be an alarm, a blinking light, a report, or a variety of other indicator types that provide an indication that an unexpected change in the monitored environment 112 has occurred.

Figure 9:
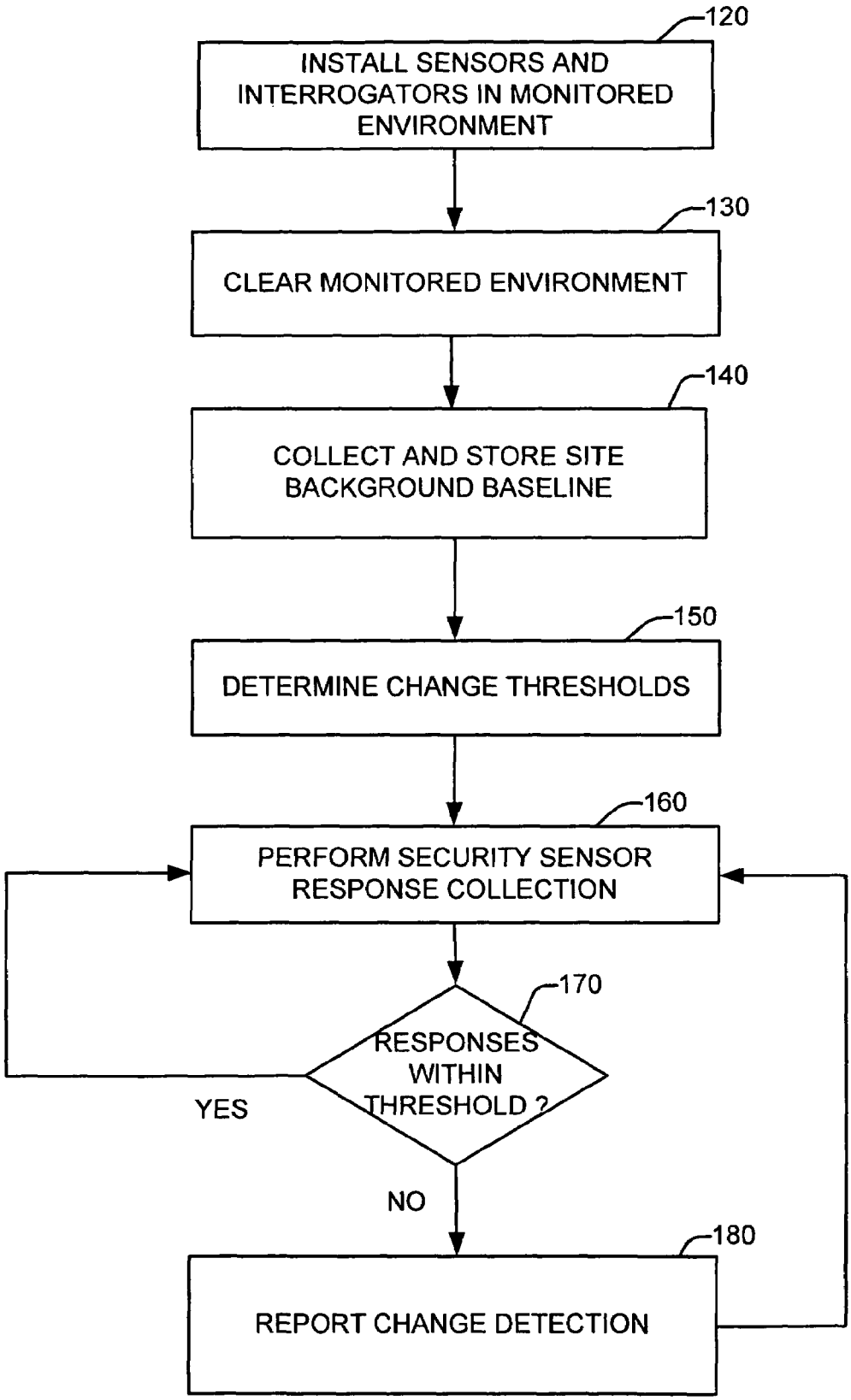
FIG. 9 illustrates a method for detecting changes in a monitored environment in accordance with an aspect of the present invention.

In view of the foregoing structural and functional features described above, a method will be better appreciated with reference to FIG. 9. It is to be understood and appreciated that the illustrated actions, in other embodiments, may occur in different orders and/or concurrently with other actions. Moreover, not all illustrated features may be required to implement a method. It is to be further understood that the following methodologies can be implemented in hardware (e.g., a computer or a computer network as one or more integrated circuits or circuit boards containing one or more microprocessors), software (e.g., as executable instructions running on one or more processors of a computer system), or any combination thereof.

FIG. 9 illustrates a methodology for detecting changes in a monitored environment in accordance with an aspect of the present invention. The methodology begins at 120 where a plurality of RF sensors is distributed about a monitored environment and one or more interrogators are installed within or about the monitored environment. At 130, the monitored environment is cleared by removing any unwanted objects, such as unwanted listening devices or other unsecured devices from the monitored environment. At 140, a background baseline is collected and stored by, for example, by continuously analyzing response patterns from the plurality of RF sensors based on interrogation sequences transmitted by the one or more interrogators over a given time period during normal background monitoring conditions. A given interrogation sequence includes transmitting interrogation signals over a set of frequency bands at one or more power levels. Additionally, one or more movable dithering reflecting plate can be disposed between the transmitter and/or receiver of one or more interrogators and the plurality of RF sensors, such that interrogation sequences can be provided by transmitting interrogation signals over a set of frequency bands over a plurality of different dithering reflecting plate positions. The interrogation signals can be transmitting employing spread spectrum frequency hopping that generates pseudo-random frequency bands over different interrogation sequences.

At 150, a plurality of change thresholds are determined based on the collected and stored background baseline response patterns. The change thresholds can be determined by analyzing a plurality of response patterns for a given sensor and determining a threshold change limit that a response pattern or an aggregate of response patterns can change before a change detection indication signal is generated. Alternatively, a plurality of pattern signatures for each sensor can be determined and stored in memory. The change thresholds can be determined based on allowable variances from the plurality of pattern signatures stored in memory. The methodology then proceeds to 160.

At 160, a security sensor response collection is performed. Security sensor response collection is performed by continuously transmitting interrogation sequences and collecting response patterns for each of the plurality of sensors during a security monitoring time period. A given response pattern can include the number of valid reads and invalid or failed reads for a given sensor at each of a corresponding frequency and power level over the entire interrogation sequence. At 170, it is determined if the collected response patterns are within the predetermined acceptable threshold. If it is determined that the collected response patterns are within the predetermined acceptable threshold (YES), the methodology returns to 160 to continue performing security sensor response collection. If it is determined that the collected response patterns are not within the predetermined acceptable threshold (YES), the methodology proceeds to 180 to report that a change detection has occurred. The methodology then returns to 160 to continue performing security sensor response collection.

Figure 10:
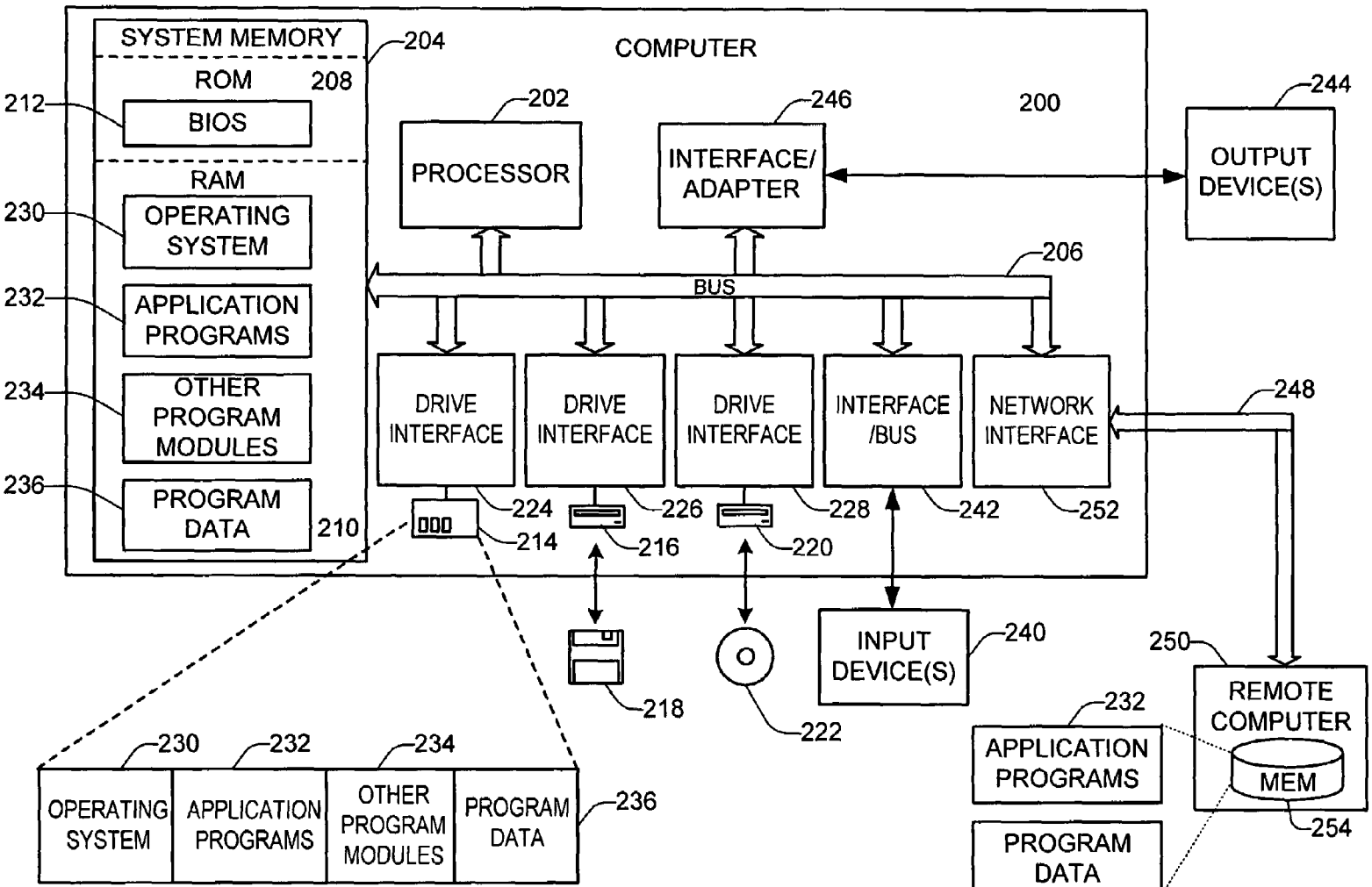
FIG. 10 illustrates an embodiment of a computer system.

FIG. 10 illustrates a computer system 200 that can be employed to implement at least portions of the systems and methods described herein, such as based on computer executable instructions running on the computer system. The computer system 200 can be implemented on one or more general purpose networked computer systems, embedded computer systems, routers, switches, server devices, client devices, various intermediate devices/nodes and/or stand alone computer systems. Additionally, the computer system 200 can be implemented as part of the computer-aided engineering (CAE) tool running computer executable instructions to perform a method as described herein.

The computer system 200 includes a processor 202 and a system memory 204. A system bus 206 couples various system components, including the system memory 204 to the processor 202. Dual microprocessors and other multi-processor architectures can also be utilized as the processor 202. The system bus 206 can be implemented as any of several types of bus structures, including a memory bus or memory controller, a peripheral bus, and a local bus using any of a variety of bus architectures. The system memory 204 includes read only memory (ROM) 208 and random access memory (RAM) 210. A basic input/output system (BIOS) 212 can reside in the ROM 208, generally containing the basic routines that help to transfer information between elements within the computer system 200, such as a reset or power-up.

The computer system 200 can include a hard disk drive 214, a magnetic disk drive 216, e.g., to read from or write to a removable disk 218, and an optical disk drive 220, e.g., for reading a CD-ROM or DVD disk 222 or to read from or write to other optical media. The hard disk drive 214, magnetic disk drive 216, and optical disk drive 220 are connected to the system bus 206 by a hard disk drive interface 224, a magnetic disk drive interface 226, and an optical drive interface 228, respectively. The drives and their associated computer-readable media provide nonvolatile storage of data, data structures, and computer-executable instructions for the computer system 200. Although the description of computer-readable media above refers to a hard disk, a removable magnetic disk and a CD, other types of media which are readable by a computer, may also be used. For example, computer executable instructions for implementing systems and methods described herein may also be stored in magnetic cassettes, flash memory cards, digital video disks and the like.

A number of program modules may also be stored in one or more of the drives as well as in the RAM 210, including an operating system 230, one or more application programs 232, other program modules 234, and program data 236. The one or more application programs can include the systems and methods for detecting changes in a monitored environment as previously described in FIGS. 1-9.

A user may enter commands and information into the computer system 200 through user input device 240, such as a keyboard, a pointing device (e.g., a mouse). Other input devices may include a microphone, a joystick, a game pad, a scanner, a touch screen, or the like. These and other input devices are often connected to the processor 202 through a corresponding interface or bus 242 that is coupled to the system bus 206. Such input devices can alternatively be connected to the system bus 206 by other interfaces, such as a parallel port, a serial port or a universal serial bus (USB). One or more output device(s) 244, such as a visual display device or printer, can also be connected to the system bus 206 via an interface or adapter 246.

The computer system 200 may operate in a networked environment using logical connections 248 to one or more remote computers 250. The remote computer 250 may be a workstation, a computer system, a router, a peer device or other common network node, and typically includes many or all of the elements described relative to the computer system 200. The logical connections 248 can include a local area network (LAN) and a wide area network (WAN).

When used in a LAN networking environment, the computer system 200 can be connected to a local network through a network interface 252. When used in a WAN networking environment, the computer system 200 can include a modem (not shown), or can be connected to a communications server via a LAN. In a networked environment, application programs 232 and program data 236 depicted relative to the computer system 200, or portions thereof, may be stored in memory 254 of the remote computer 250.

What have been described above are examples of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. A system for detecting changes in a monitored environment, the system comprising:

a plurality of radio frequency (RF) sensors distributed about the monitored environment, each RF sensor configured to respond to an interrogation signal with a unique identifier;

a radio frequency (RF) interrogator that transmits interrogation sequences of interrogations signals over a plurality of different frequency bands at one or more power levels; and a response pattern analyzer that determines response patterns for each of the plurality of RF sensors to the interrogation sequences and transmits a change detection indicator if at least one of the determined response patterns vary outside a predetermined background baseline.

2. The system of claim 1, the RF interrogator transmits interrogation sequences of interrogations signals employing spread spectrum frequency hopping to generate pseudo-random frequency bands over different interrogation sequences.

3. The system of claim 1, the predetermined background baseline comprising a plurality of response pattern signatures associated with normal monitoring conditions of the monitored environment, the response pattern analyzer transmits a change detection indicator if the determined response patterns vary outside predetermined thresholds of the plurality or response pattern signatures.

4. The system of claim 1, the predetermined background baseline comprising a plurality of predetermined change thresholds determined based on response patterns received during normal monitoring background conditions of the monitored environment.

5. The system of claim 1, wherein each response pattern is a binary sequence based on valid reads and failed reads for one or more interrogation sequences at one or more power levels.

6. The system of claim 1, wherein the response pattern analyzer comprises:

an RF sensor response pattern storage for storing RF sensor response patterns from the RF interrogator; and a RF sensor response pattern comparator that compares the stored RF sensor response patterns with the predetermined background baseline.

7. The system of claim 1, wherein the response pattern analyzer transmits a request to the RF interrogator to increase a rate of transmitting interrogation sequences upon detecting a change in the monitored environment.

8. The system of claim 1, wherein the response pattern analyzer tracks movement of an intruder entering the monitored environment upon detecting a change in the monitored environment.

9. The system of claim 1, wherein the response pattern analyzer tracks movement of an intruder entering the monitored environment upon detecting a change in the monitored environment by maintaining and comparing multiple temporary background baselines to determine if the intrusion has ceased if a final background baseline matches a last temporary background baseline.

10. The system of claim 9, wherein the response pattern analyzer compares a last temporary background baseline to the predetermined background baseline to determine if a change has occurred to the monitored environment as a result of the intrusion.

11. The system of claim 1, further comprising one or more movable dithering reflecting plates located between the RF interrogator and at least one of the plurality of RF sensors, and configured to move over different positions to modify the transmission distance, receipt power and/or alter the multi-path effects of the interrogation signals of the RF interrogator and/or response patterns of the at least one of the plurality of RF sensors.

12. A security system for detecting changes in a monitored environment, the system comprising:

a plurality of means for responding to an interrogation signal with a unique identifier, the plurality of means for responding being distributed about the monitored environment;

means for transmitting interrogation sequences of interrogations signals over a plurality of different frequency bands at a plurality of power levels;

means for determining response patterns for each of the plurality of RF sensors to the interrogation sequences;

means for determining if response patterns vary outside a predetermined background baseline; and means for providing an indication if response patterns vary outside the predetermined background baseline.

13. The system of claim 12, the means for transmitting the interrogation sequences of interrogations signals employing spread spectrum frequency hopping to generate pseudo-random frequency bands over different interrogation sequences.

14. The system of claim 12, the predetermined background baseline comprising a plurality of response pattern signatures associated with normal background monitoring conditions of the monitored environment.

15. The system of claim 12, the predetermined background baseline comprising a plurality of predetermined change thresholds determined based on response patterns received during normal background monitoring conditions of the monitored environment.

16. The system of claim 12, wherein each response pattern is a binary sequence based on valid reads and failed reads for one or more interrogation sequences at one or more power levels.

17. A method for detecting changes in a monitored environment, the method comprising:

distributing a plurality of radio frequency (RF) sensors about the monitored environment, each RF sensor configured to respond to an interrogation signal with a unique identifier;

repeatedly transmitting interrogation sequences of interrogations signals over a plurality of different frequency bands at one or more power levels for a given time period;

determining response patterns for each of the plurality of RF sensors to the interrogation sequences to determine a background baseline;

determining and storing change thresholds from the determined background baseline;

repeatedly transmitting the interrogation sequences of interrogations signals over the plurality of different frequency bands at one or more power levels during a security monitoring time period to determine changes in the monitored environment; and transmitting a change detection indicator if at least one of the determined response patterns vary outside the change thresholds.

18. The method of claim 17, the site background baseline comprising a plurality of response pattern signatures associated with normal background monitoring conditions of the monitored environment, the change thresholds being associated with variances from the plurality of response pattern signatures.

19. The method of claim 17, the site background baseline comprising a plurality of predetermined change thresholds determined based on response patterns received during normal monitoring conditions of the monitored environment.

20. The method of claim 17, further comprising transmits a request to increase a rate of transmitting interrogation sequences upon detecting a change in the monitored environment.

21. The method of claim 17, further comprising:

tracking movement of an intruder entering the monitored environment upon detecting a change in the monitored environment by maintaining and comparing multiple temporary background baselines to determine if the intrusion has ceased if a final background baseline matches a last temporary site background baseline; and comparing a last temporary background baseline to the background baseline to determine if a change has occurred to the monitored environment as a result of the intrusion.

22. The method of claim 17, wherein repeatedly transmitting interrogation sequences of interrogations signals over a plurality of different frequency bands at one or more power levels for a given time period further comprises moving at least one reflecting dithering plate to different positions during the interrogation sequences to modify the transmission distance, receipt power and/or alter the multi-path effects of the interrogation signals and/or response patterns of the at least one of the plurality of RF sensors.

* * * * *